US007129837B2

(12) United States Patent
Shannon et al.

(10) Patent No.: US 7,129,837 B2
(45) Date of Patent: Oct. 31, 2006

(54) CONTINUOUS SECURITY STATE TRACKING FOR INTERMODAL CONTAINERS TRANSPORTED THROUGH A GLOBAL SUPPLY CHAIN

(75) Inventors: David L. Shannon, State College, PA (US); Gregory Y. H. Lee, Singapore (SG); Christopher A. Stephenson, Redwood City, CA (US)

(73) Assignee: Savi Technology, Inc., Sunnyvale, CA (US)

( * ) Notice: Subject to any disclaimer, the term of this patent is extended or adjusted under 35 U.S.C. 154(b) by 0 days.

(21) Appl. No.: 10/821,296

(22) Filed: Apr. 8, 2004

(65) Prior Publication Data

US 2004/0227630 A1 Nov. 18, 2004

Related U.S. Application Data

(60) Provisional application No. 60/514,968, filed on Oct. 27, 2003, provisional application No. 60/470,294, filed on May 13, 2003, provisional application No. 60/461,946, filed on Apr. 9, 2003.

(51) Int. Cl.
*G08B 1/08* (2006.01)

(52) U.S. Cl. ..... 340/539.13; 340/568.5; 340/571; 340/572.1; 235/375; 235/384; 235/385; 455/456.5; 455/456.6

(58) Field of Classification Search ..... 340/539.13, 340/568.1, 568.5, 571, 572.1; 235/275, 384, 235/385; 455/456.5, 456.6
See application file for complete search history.

(56) References Cited

U.S. PATENT DOCUMENTS 4,688,244 A * 8/1987 Hannon et al. ..... 377/58
5,565,858 A 10/1996 Guthrie
5,568,858 A 10/1996 Thompson
5,835,012 A 11/1998 Wilk
5,892,441 A 4/1999 Woolley et al.
5,959,568 A 9/1999 Woolley
6,148,291 A 11/2000 Radican
6,211,781 B1 4/2001 McDonald
6,714,121 B1 3/2004 Moore
6,820,805 B1 11/2004 Stevens
6,927,687 B1 8/2005 Carrender
2001/0018672 A1 8/2001 Petters et al.

(Continued)

OTHER PUBLICATIONS

Notification Of The International Search Report Or The Declaration and Written Opinion Of The International Searching Authority, PCT/US04/14206, Apr. 28, 2005, 9 pages.

(Continued)

*Primary Examiner*—Julie Bichngoc Lieu
(74) *Attorney, Agent, or Firm*—Fenwick & West LLP

(57) ABSTRACT

A control center continuously monitors a security state of a container through an extended network spanning from a shipper to a consignee. The control center changes the security state responsive to explicit information received from a trusted agent, or implicit information deducted from business logic. A trusted shipper agent sends manifest information from a shipper checkpoint to the data center that includes, for example, container information, shipping route information, and other security information. Trusted monitor agents continuously track the security state from the shipper checkpoint to the origin checkpoint, from the origin checkpoint to a destination checkpoint, and from the destination checkpoint to a consignee checkpoint. A trusted consignee agent sends termination information from the consignee checkpoint to the data center. The checkpoints further comprise site managers to communicate information, gathered by RFID (Radio Frequency IDentification) readers from RFID tags on containers, to the control center.

36 Claims, 10 Drawing Sheets

U.S. PATENT DOCUMENTS

| | | | | |
|---|---|---|---|---|
| 2002/0029178 | A1 | 3/2002 | Wiederin et al. | |
| 2003/0125980 | A1 | 7/2003 | Ribeiro | |
| 2003/0227382 | A1* | 12/2003 | Breed | 340/539.13 |
| 2004/0100379 | A1* | 5/2004 | Boman et al. | 340/539.26 |

OTHER PUBLICATIONS

Notification of Transmittial of the International Search Report and the Written Opinion of the International Searching Authority, or the Declaration, PCT Application No. PCT/US04/15166, Sep. 6, 2005, 6 pages.

Notification of Transmittal of the International Search Report and the Written Opinion, PCT/US04/14192, Jan. 18, 2006, 8 pages.

"Guidance from AIM Global'RFID Expert Group: Proposed Guidelines for the Use of RFID-Enabled Labels in Military Logistics: Recommendations for Revision of MIL-STD-129," AIM Global, May 13, 2005, 39 pages.

"RFID Product Requirements for the Savi Total Asset Visibility Portable Deployment Kit," 2004, Savi Technology, Inc., 25 pages.

"Savi® Portable Deployment Kit;" Active RFID Technology, Savi Technology, 1 page.

International Search Report and the Written Opinion, PCT/US04/41501, Nov. 3, 2005, 11 pages.

* cited by examiner

CONTINUOUS SECURITY STATE TRACKING FOR INTERMODAL CONTAINERS TRANSPORTED THROUGH A GLOBAL SUPPLY CHAIN

CROSS REFERENCE TO RELATED APPLICATIONS

This application is related to: U.S. Provisional Patent Application No. 60/461,946, filed on Apr. 9, 2003, entitled "Method and Apparatus for Managing, Securing, and Tracking Intermodal Containers Through the Global Supply Chain," by David Shannon, from which priority is claimed under 35 U.S.C. § 119(e); U.S. Provisional Application No. U.S. Patent Application No. 60/470,294, filed May 13, 2003, entitled "Global Supply Chain Federation," by David Shannon; and U.S. Provisional Patent Application No. 60/514,968, filed Oct. 27, 2003, entitled "Mechanisms for Secure RF Tags on Containers," by Ravi Rajapakse et al., the entire contents of each being herein incorporated by reference.

BACKGROUND OF THE INVENTION

1. Field of the Invention

This invention relates generally to tracking cargo and, more specifically, to continuously monitoring cargo as it is transported by various modes and handed-off through points in a global supply chain.

2. Background Art

Ever-increasing global trade underscores a modern global economy which depends on goods transported in a global supply chain. Generally, a global supply chain is a network of international suppliers, manufacturers, distributors, and other entities that handle goods from their component parts to consumer consumption. For example, semiconductor testing equipment is exported from the United States to Taiwan, where semiconductors are processed and then sent to Malaysia for assembly into computers. Subsequently, the computers are shipped to warehouses in the United States, and ultimately, to consumer outlets for consumption.

However, nonuniform customs procedures and security standards at exporting country borders make importing countries susceptible to a lowest common denominator. Some export countries have less motivation and/or ability to police exported goods, and thus, perform little or no export inspections. Further, because the importing country only has physical jurisdiction at its borders, a Customs Agency has limited opportunity to enforce heightened inspections and security. A resulting tension arises between quickly inspecting all imports and thoroughly inspecting certain imports. Moreover, this tension is exacerbated by increasing national border threats, such as terrorist activities, that take advantage of disparate standards within cargo transport to illegally import unauthorized goods.

Even when the exporting and importing countries have similar standards, the lapse of security between countries provides ample opportunity for security breaches. During this unmonitored period, cargo that was secure at an export port can be compromised for illegal purposes. Furthermore, goods can be stolen during this period without being noticed until a full inventory is taken.

Within an internal supply chain, private companies seek to increase operational efficiency. For example, to avoid warehousing large stocks of goods, a distributor unit of a company may place orders at a manufacturing unit on an as needed basis. But to avoid inventory depletion, the distributor unit must have historical and current information about shipping duration and other supply chain metrics to ensure that goods arrive in a timely fashion.

Therefore, what is needed is a container tracking system that controls container security starting as early in the process as possible, and continuously monitors the container for security breaches during transport to ensure that the container remains secure through receipt. Moreover, the solution should report aggregated information concerning performance metrics within a supply chain.

SUMMARY OF THE INVENTION

The present invention meets these needs with a system and method to continuously track a security state for an intermodal container. As a result, a governmental agency such as a Customs Agency can extend its reach past its own borders in monitoring imported cargo to prevent terrorist activities and other deviant acts. Moreover, with pre-authorizations and standardized inspections occurring at the point of export or earlier, less inspection is required at the import border itself. Additionally, a private agency can ensure standardized security and operational procedures that reduce theft and increase operational efficiency within its own internal supply chain.

In some embodiments, a control center continuously tracks the security state through a primary network spanning from an origin checkpoint to a destination checkpoint. The control center initiates the security state with origin information for a secured container at an origin checkpoint. The control center monitors the container for security breaches as it is transported from the origin checkpoint to a destination checkpoint. The control center then validates or resets the security state at the destination checkpoint with destination information. Information can explicitly change the security state with an alert, or implicitly change the security state after applying security business rules.

In some embodiments, the control center continuously monitors the security state through an extended network spanning from a shipper to a consignee. A trusted shipper agent sends manifest information from a shipper checkpoint to the data center that includes, for example, container information, shipping route information, and other security information. A first monitor agent tracks the security state from the shipper checkpoint to the origin checkpoint of the primary network. A second monitor agent tracks the security state from the destination checkpoint of the primary network to a consignee checkpoint. In one embodiment, the control center changes the security state using monitoring information as inputs for a security state machine. A trusted consignee agent sends termination information from the consignee checkpoint to the data center.

In some embodiments, trusted agents distributed around a global supply chain perform standardized security tasks and provide security state information to the control center. As such, a trusted origin agent seals the container, associates seal and container identities, sets an expected transport route, sets planned security events, and/or records departure. A trusted monitor agent raises an alert responsive to seal tampering, deviations from an expected transport route, and other security breaches. A trusted destination agent records arrival of the container, inspects the container condition, validates the security state, resecures the container if necessary and/or resets the security state.

In some embodiments, the container comprises a device tag, such as an RFID (Radio Frequency IDentification) tag associated with GPS (Geographic Positioning System) information. The checkpoints comprise readers, such as RFID readers to detect and communicate with RFID tags. The checkpoints further comprise site managers to send information gathered by the readers to the control center. A communication channel between the site managers and the control center comprises, for example, a secure network connection enabled by satellite or other wireless communication devices. Another embodiment comprises a plurality of control centers that handoff monitoring tasks, each site manager communicating with at least one of the control centers.

The features and advantages described in this summary and the following detailed description are not all-inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTIONS OF THE PREFERRED EMBODIMENTS

A system and method for tracking a security state of an intermodal container is disclosed. A system according to some embodiments of the present invention is set forth in FIGS. 1–5, and methods operating therein, according to some embodiments of the present invention, are set forth in FIGS. 6–9. In one embodiment, the system initiates, monitors, and then validates or resets the security state as the container travels through a global supply chain.

The accompanying description is for the purpose of providing a thorough explanation with numerous specific details. Of course, the field of cargo tracking is such that many different variations of the illustrated and described features of the invention are possible. Those skilled in the art will thus undoubtedly appreciate that the invention can be practiced without some specific details described below, and indeed will see that many other variations and embodiments of the invention can be practiced while still satisfying its teachings and spirit. Accordingly, the present invention should not be understood as being limited to the specific implementations described below, but only by the claims that follow.

The processes, features, or functions of the present invention can be implemented by program instructions that execute in an appropriate computing device. Example computing devices include enterprise servers, application servers, workstations, personal computers, network computers, network appliances, personal digital assistants, game consoles, televisions, set-top boxes, premises automation equipment, point-of-sale terminals, automobiles, and personal communications devices. The program instructions can be distributed on a computer readable medium, storage volume, or the Internet. Program instructions can be in any appropriate form, such as source code, object code, or scripting code.

Figure 1:
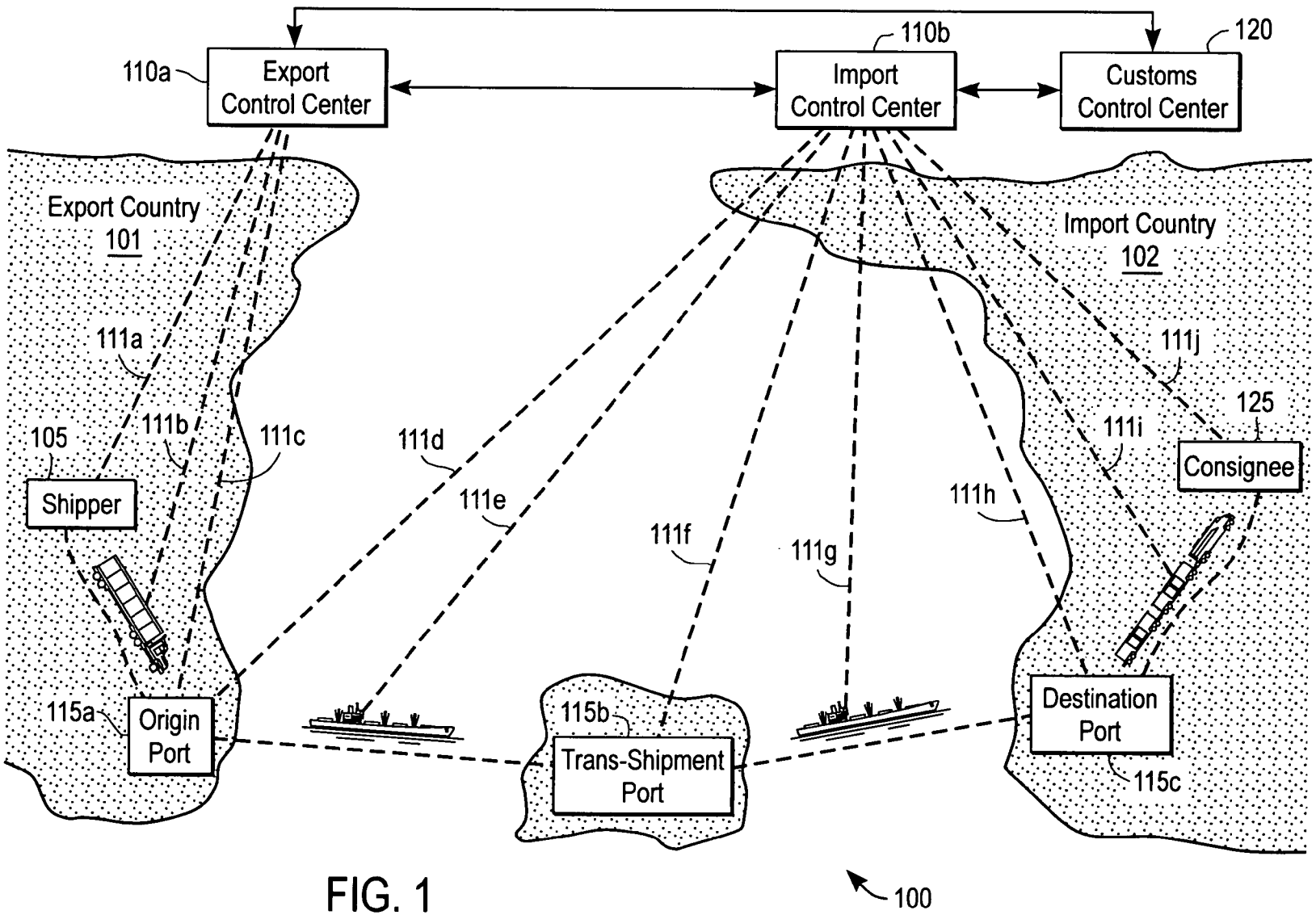
FIG. 1 is a schematic diagram illustrating a security state tracking system in a global supply chain according to one embodiment of the present invention.

FIG. 1 is a block diagram illustrating a security state tracking system 100 in a global supply chain according to one embodiment of the present invention. Note that FIG. 1 is merely an example global supply chain (collectively 105, 115*a*–*c*, 125) that can have various geographical configurations, modes of transport, etc. within the scope and spirit of the present invention. The system 100 comprises an export control center 110*a*, an import control center 110*b*, and a customs control center 120 in communication with the global supply chain. The global supply chain comprises a shipper 105, an origin port 115*a*, a transshipment port 115*b*, a destination port 115*c*, and a consignee 125. In one embodiment, the system 100 components are realized with computing devices executing code.

At a high-level, the shipper 105 transports a container (illustrated in FIG. 5) to the consignee 125 via one of many trade routes, only one of which is shown in the example of FIG. 1. As a first mode of transportation, a truck transports the container from the shipper 105 to the origin port 115a. As a second and a third mode of transportation, a first vessel and a second vessel transport the container from the origin port 115*a* to the destination port 115*c* with a transfer at a transshipment port 115*b*. As a fourth mode of transportation, a freight train transports the container to the consignee 125.

The origin, transshipment, and destination ports 115*a*–*c* represent a major trade artery and are thus considered to be a primary network for security state information. On the other hand, the shipper 105 and the consignee 125 represent ones of numerous tributaries stemming from the origin and destination ports 115*a,c* and are thus considered to be an extended network of security state information. In the case of international transportation, governmental agencies of the corresponding countries 101, 102, such as a Customs and National Security Agencies, exercise oversight over components of the primary network while private parties exercise oversight over components of the extended network. Note that, however, in one embodiment, the transportation occurs within the borders of a single country. As such, exporting and importing is between intranational geographical locations (e.g., between two states, cities, provinces, etc.) overseen by, for example, a security agency or an intranational governmental agency. Problematically, nonuniform security standards experienced through the disparate collection of transport modes makes the container arriving at the consignee 125 susceptible to the weakest link of security in the global supply chain.

The communication lines 111*a–j* provide data communication between the control centers 110*a–b* and points along the global supply chain. The communication lines 111*a–j* can be enabled by, for example, a wired or wireless network connection, a satellite, a telephone line, and the like. In a preferred embodiment, during transportation between two points, one or more satellites are able to continuously communicate with container. Additionally, satellite communication provides world-wide data communication to geographical areas lacking wire communication infrastructure. Satellite communication may also be combined with a GPS (Geographic Positioning System) in order to track geographic positions of the container.

The export control center 110*a* tracks the security state through an export country 101 in the form of a required body of information. The required body of information, discussed in greater detail below, is a collection of information concerning the container submitted from various points within the global supply chain. In one embodiment, the export control center 110*a* initiates the security state with manifest information received from the shipper 105 before the container is sealed. As the container travels through the first transport mode, the export control center 110*a* monitors the security state for security breaches. The export control center 110*a* validates or resets the security state with information received from the origin port 115*a*. In one embodiment where the export control center 110*a* does not have the benefit of communication with the extended network or trusted agents therein, the export control center 110*a* begins container tracking in the primary network at the origin port 115*a*.

The export control center 110*a* also communicates with the import control center 110*b* and the customs control center 120 through, for example, a secure network. The export control center 110*a* sends information within the required body of information from the portion of the global supply chain in the export country 101 to the import control center 110*b* until a handoff to the import control center 110*b* occurs at the origin port 115*a*. Preferably the handoff is tightly coupled, and can include logical processes as well as data exchanged between local agents as described in U.S. Patent Application No. 60/470,294. Additionally, the export control center 110*a* sends messages from the import and customs control centers 110*b*, 120 to agents in the global supply chain. For example, the customs control center 120 can require additional inspection procedures for a container that contravenes security policies of the import country 102.

The import control center 110*b* tracks the security state through an import country 102 and also maintains the required body of information. The import control center 110*b* begins monitoring at the origin port 115*a* where it can validate or reset the security state at the same time as the export control center 110*a*. Thus, there is no lapse in monitoring the container between the export and import control centers 110*a–b*. As the container travels through the second and third transport modes, the import control center 110*b* monitors the security state for security breaches. The import control center 110*b* then validates or resets the security state at the destination port 115*c* with destination information. In the extended network, the import control center 110*b* monitors the fourth transport mode and terminates the security state once the container reaches the consignee 125. In one embodiment, the import and export control centers 110*a–b* are operated by a common private enterprise, and in another embodiment, by separate governmental entities that nonetheless use compatible formatting. A representative control center 110 is described in greater detail below.

The customs control center 120 implements policy-based control over containers and provides reporting to end-users. More specifically, the customs control center 120 uses a set of business rules (or business logic) to implement security actions responsive to certain input conditions. For example, the customs control center 120 is able to require additional inspections and screening procedures on a particular container, or reject the container altogether, due to a heightened security status with respect to a particular export country 101 or trade route. In another example, a container that has experienced more than one security alert may be subjected to additional inspection at a transshipment port 115*b*, even if a security alert did not occur during an immediately preceding transport mode. A customs agent can also implement security actions by, for example, manually dispatching discriminatory inspections responsive to intelligence about a particular shipper 105 and the like. On the other hand, and as a benefit of the present invention, the customs control center 120 is able to ease inspection requirements for selected containers under satisfactory continuous monitoring. The customs control center 120 can further include an end-user communication interface (not shown) that provides security or customs agents with database access or generated reports. The end-user communication interface can also send alerts to security or customs agents via pager, e-mail, web browser, and the like to notify them of, for instance, security alerts.

The global supply chain is a network of international suppliers, manufacturers, distributors, and other entities that handle goods from their component parts to consumer consumption. As such, objects interchangeably described herein as goods, containers, cargo, freight, and boxes, pass through the network points, checkpoints, ports, etc. The shipper 105 and the consignee 125 can be direct or indirect partner entities or units within a single entity exchanging a container though a trade route. For example, a manufacturer sends computer components to an assembly plant by truck freight, which in turn ships assembled computers to a warehouse. The origin and destination ports 115*a–b* can be a shipping dock, an airport, a customs agency, an NVOCC (Non-Vessel Operating Common Carrier) or any other entity that sends and/or receives goods over a trade route. A representative port 115 is described in greater detail below with respect to FIG. 4. An internal supply chain is a similar network operated by a single entity or closely-associated entities.

Trusted agents at points along the global supply chain can be human agents operating devices in communication with the system 100, or computer agents performing automated processes. An agent can attain trusted status, for example, by following C-TPAT (Customs-Trade Partnership Against Terrorism) regulations or obtaining C-TPAT certifications. The trusted agent presents credentials to the system 100 when logging in by using a password, biometric identification, or other identification methods.

Figure 2:
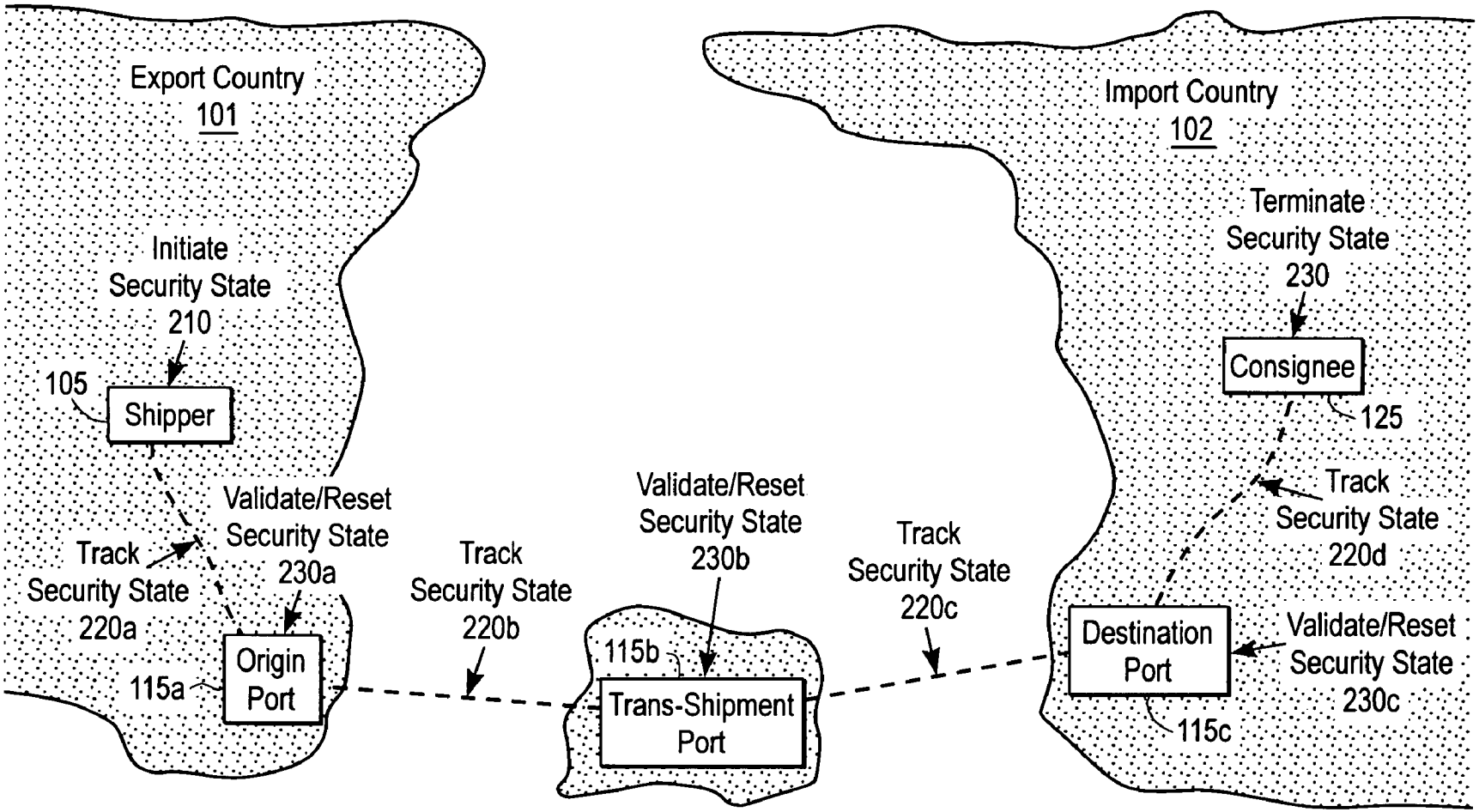
FIG. 2 is a schematic diagram illustrating security state events within the security state tracking system according to one embodiment of the present invention.

FIG. 2 is a block diagram illustrating security state events within the security state tracking system 100 according to one embodiment of the present invention. These security state events can explicitly or implicitly affect the security state associated with a container. Seal devices attached to the container, as described in one embodiment below with respect to FIG. 5, trusted agents, and other information gathering devices report information related to security state events through the communication channels 111*a–j*. As a result, the system 100 may change the security state. More specifically, the shipper 105 initiates 210 the security state, the various transportation modes track (or monitor) 220*a–d* the security state, the ports 115*a–c* validate or reset the security state, and the consignee 125 terminates the security state. One of ordinary skill in the art will recognize that such divisions of labor are provided for simplicity and that variations are within the scope of the present invention. For example, the security state can also be tracked 220 while being stored at a port 115. Similarly, the security state can also be validated or reset during transport between points. The security state events are discussed in greater detail below with respect to FIG. 6.

Security state events can be static or dynamic. Static events produce after-the-fact information. For example, static information can be included in an EDI (Electronic Data Interchange) message sent periodically, rather than in real-time. On the other hand, dynamic information occurs closer to real-time. For example, real-time tampered seal or routing information can be constantly received and evaluated.

Figure 3A:
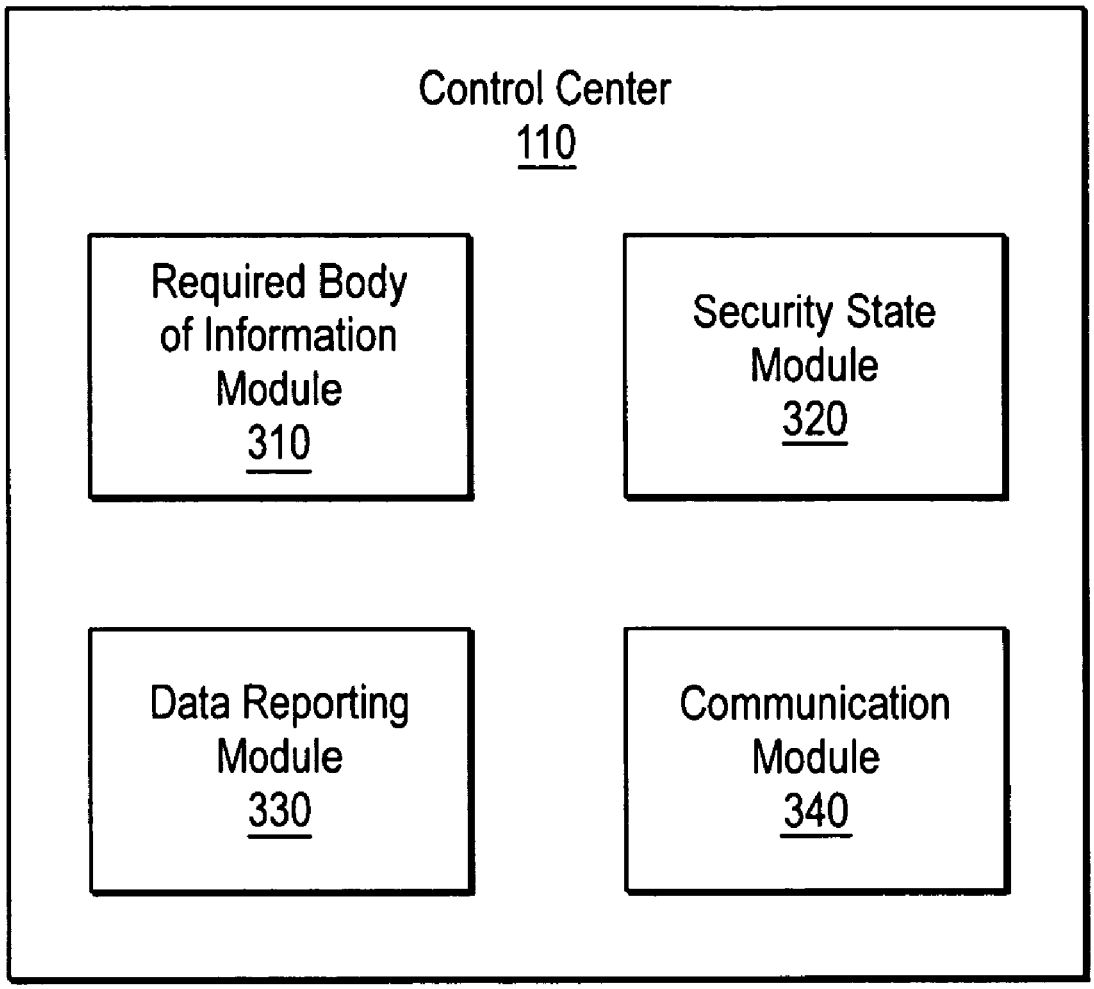
FIG. 3A is a block diagram illustrating a representative control center according to one embodiment of the present invention.

FIG. 3A is a block diagram illustrating a representative control center 110 according to one embodiment of the present invention. More specifically, the control center 110 comprises a required body of information module 310, a security state module 320, a data reporting module 330, and a communication module 340.

The required body of information module 310 maintains standardized information concerning the container at a central point. In one embodiment, the required body of information module 310 maintains the information in a required body of information which is a data structure containing static and/or dynamic information including, for example, manifest information, origin information, monitoring information, destination information, termination information, etc. provided by trusted agents and points in the global supply chain. The required body of information is described in further detail below with respect to Table 1.

The security state module 320 determines when the security state changes to an alert or other security state, or maintains its status quo in response to information gathered from points within the global supply chain. The security state module 320 can receive a raised alert or other security state from trusted agents, such as a port agent that subjectively observes a container or a seal device indicative of tampering. The security state module 320 can also raise an alert on its own using business logic (e.g., FIG. 3B), for example, due to a lapse in communication during tracking.

The data reporting module 330 generates aggregate reports from required bodies of information. The report includes analysis of changes in security state, deviations between anticipated and actual statistics such as transport time and route, and other metrics related to security and operational efficiency. The reports can provide specific aggregate information related to a shipper 105, origin port 115*a*, commodity, transport mode, and the like. The data reporting module 330 sends the report to the custom control center 120 for access by end-users in policy-based decision making.

The communication module 340 interfaces with communication channels used to exchange information with trusted agents, other control centers 110, the customs control center 120, etc. The communications module 340 includes logical software ports and/or hardware connections to communicate via Ethernet, telephone line, and the like. The communications module 340 also transfers data between data protocols such as HTTP, HTTPS, business data protocols, and secure mobile object passing.

Figure 3B:
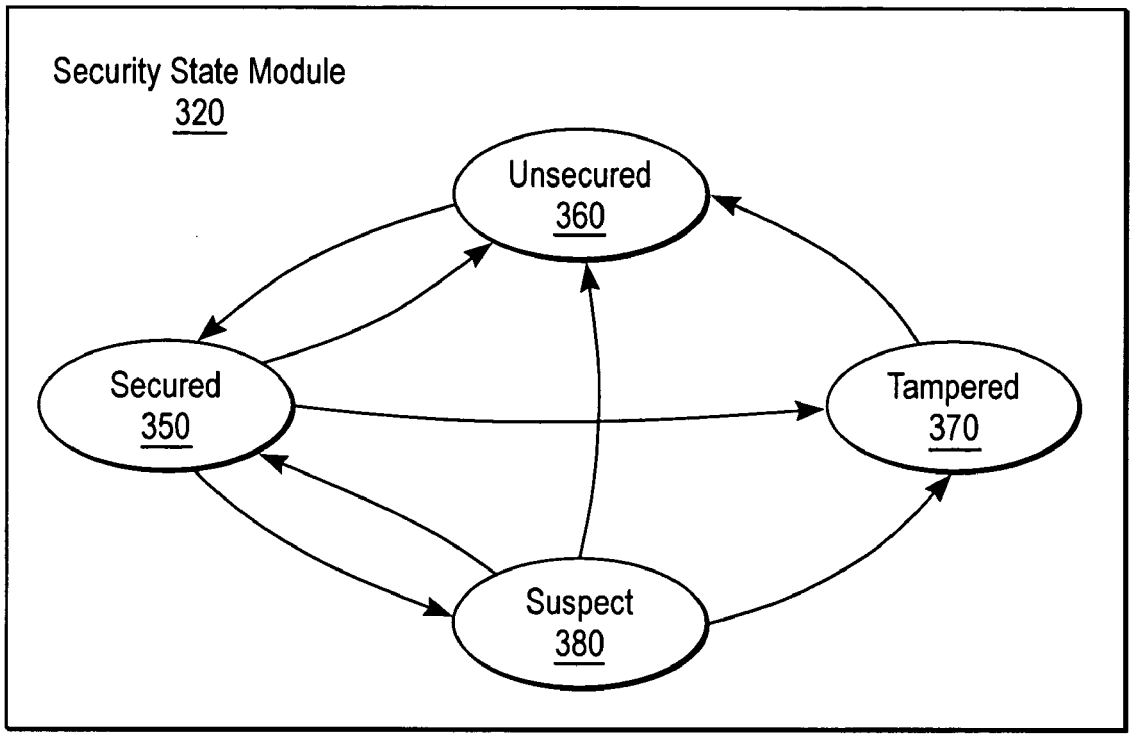
FIG. 3B is a state diagram illustrating a security state machine within the security state module according to one embodiment of the present invention.

FIG. 3B is a state diagram illustrating a security state machine within the security state module 320 according to one embodiment of the present invention. The security state machine realizes business rules implemented in a state machine. The nodes 350, 360, 370, 380 represent potential security states at different times of points during monitoring. The security state, as used herein, refers to an explicit or implied status or condition of the container subject to transport, or associated devices. Note that FIG. 3B is merely an example and various implementations include additional or fewer potential security states, and additional or fewer transitions between nodes responsive to business rules.

The security state module 320 determines security states either directly from information collected by agents, or indirectly by first applying security business rules to the information. The secured node 350 refers to containers having assigned and locked seals while satisfying business rules. The unsecured node 360 refers to containers having at least one seal assigned and unlocked while satisfying business rules. The suspect node 380 refers to containers that fail at least one business rule without regard to whether a seal is assigned or unlocked. Also, the tampered node 370 refers to containers having at least one tampered with seal without regard to business rules.

Transitions occur when triggering changes in information are detected by the security state module 320. In one example, the status is initiated at the secured node 350 responsive to an inspection, and/or sealing at the shipper 105. In another example, the security state module 320 transitions from the secured node 350 to the unsecured node 360 responsive to receiving a seal unlocked alert from a monitoring agent. In yet another example, the security state module 320 transitions from the secured node 350 to the suspect node 380 responsive to a failing business rule such as when unexpected container location is received from a monitoring agent. In still another example, the security state module 320 transitions from the secured node 350 to the tampered node 370 responsive to receiving a seal open alert from a monitoring agent. The tampered node 370 of a preferred embodiment, is physically cleared by removing and/or resetting the seal, resulting in a transition through the unsecured node 360 prior to transitioning to the secured node 350. Also, collected information comprises a condition related to the security state. For example, environmental conditions include temperature, humidity, vibration, shock, light, and radiation. The security state module 320 transitions to a suspect, unsecured, or tampered node 360, 370, 380 when conditions become abnormal as determined by business logic, the seal itself, or otherwise.

Figure 4:
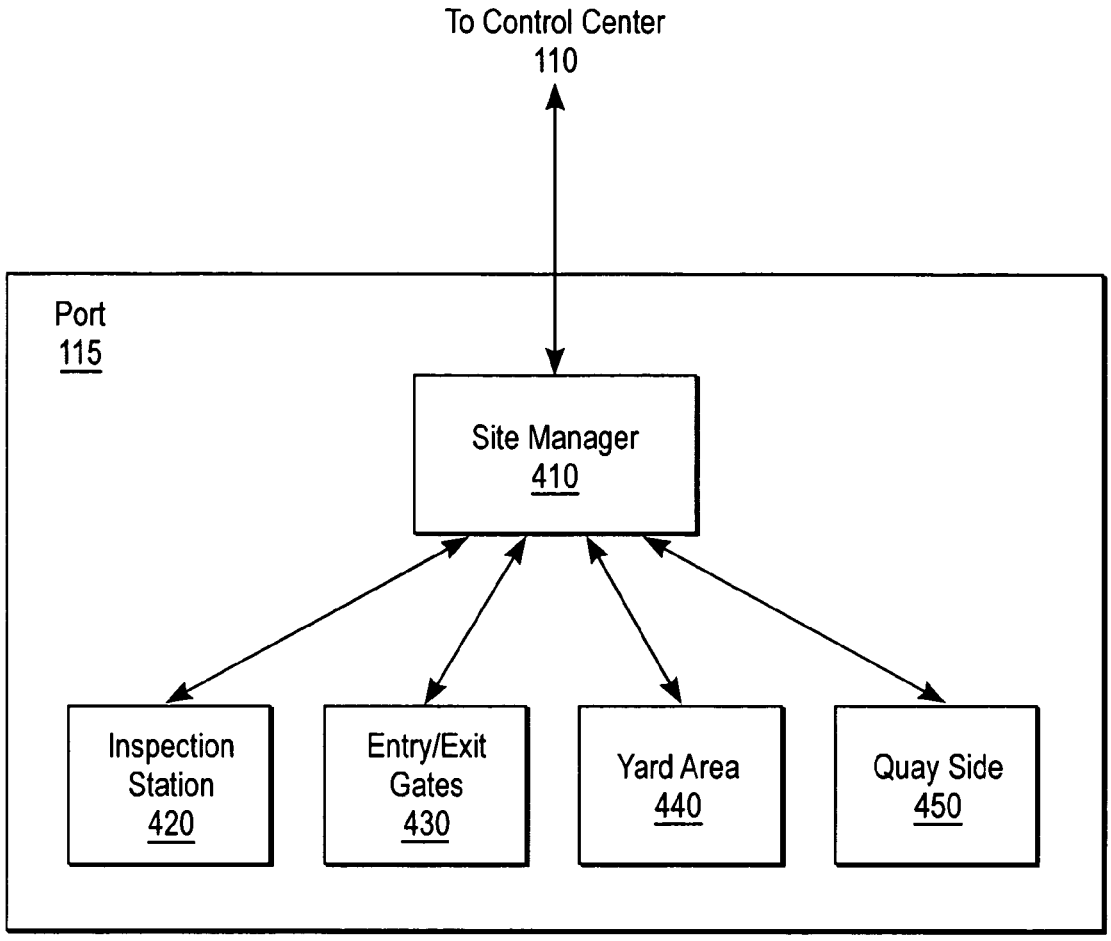
FIG. 4 is a block diagram illustrating a representative port according to one embodiment of the present invention.

FIG. 4 is a block diagram illustrating a representative port 115 according to one embodiment of the present invention. The port 115 comprises a site manager 410, an inspection station 420, entry/exit gates 430, a yard area 440, and a quay side 450. A trusted agent inputs information into the system 100 using devices such as a hand-held computer, a PDA (Personal Digital Assistant), a laptop computer, a keyboard, an RFID (Radio Frequency Identification) device or other data entry mechanism.

Several areas around the port 115 provide monitoring information to the system 100 via, for example, RFID readers. The inspection station 420 enables intrusive and/or nonintrusive container inspection. An example intrusive inspection uses a staging area to open containers and visually inspect contents according to standardized procedures. The trusted agent makes subjective and objective determinations about, at least in part, the security state. An example nonintrusive inspection uses an x-ray or gamma ray machine, a bomb detection device, etc. The entry/exit gates 430 log in and log out containers as they enter and exit the port 115 facility. The yard area 440 stores unloaded containers awaiting shipping. The quay side 450 is part of a wharf located at a shoreline to load and unload containers on a vessel.

The site manager 410 provides a centralized communication interface with the control centers 110. The site manager 410 recognizes RFID readers within the port 115 and initializes communication through appropriate protocols. In one embodiment, the site manager 410 is able to communicate with heterogeneous RFID readers using differing protocols. The RFID readers send information to the site manager 410 which can reformat the information into monitoring information compatible with the required body of information.

Figure 5:
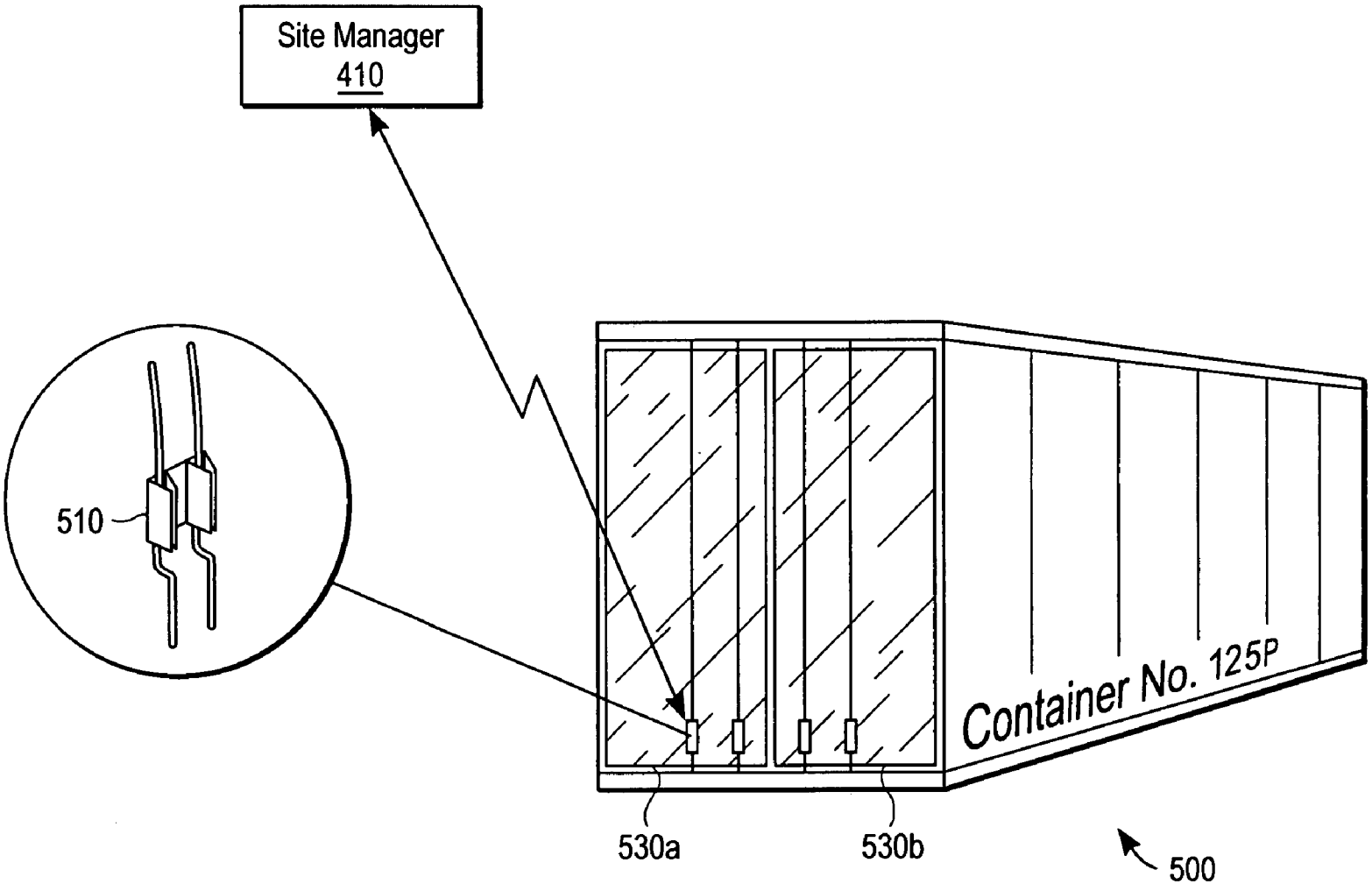
FIG. 5 is a schematic diagram illustrating an example container with a seal device according to one embodiment of the present invention.

FIG. 5 is a schematic diagram illustrating an example container 500 with seal device 510 according to one embodiment of the present invention. The container 500 stores several smaller containers, cargo, packages or goods. The container 500 includes doors 530*a–b* and seal devices 510. The container 500 has slidable vertical bars attached to keep the doors 530*a–b* closed. Note that the container 500 is merely an example as it can vary in size, shape, and configuration (e.g., more than two doors).

The seal devices 510 are coupled, attached or otherwise integrated with the container 500 in a position to detect security breaches. When one of the doors 530*a–b* is opened or when there is an attempt to open one of the doors 530*a–b*, the seal device 510 detects movement. As a result, the detecting seal device 510 sends a signal indicating a security breach to the site manager 410. In another embodiment, the site manager 410 can periodically poll the seal device 510 for information. The seal device 510 can be a passive or an active RFID device. The security device 510 contains a memory to store identification (e.g., unique seal key) and control information (e.g., seal status, seal event log, etc.). The seal device 510 can comprise a spring clamp for mounting. Moreover, the seal device 510 can comprise a sensor module to detect security breaches and/or environmental conditions associated with the container 500. Security breaches include, but are not limited to, a door open, an attempt to open a door, right door open, left door open, both doors open, and more than one door open. Environmental conditions include, but are not limited to, temperature, humidity, vibration, shock, light, and radiation. Further embodiments of seal devices 510 are described in U.S. Provisional Patent Application No. 60/514,968.

Figure 6:
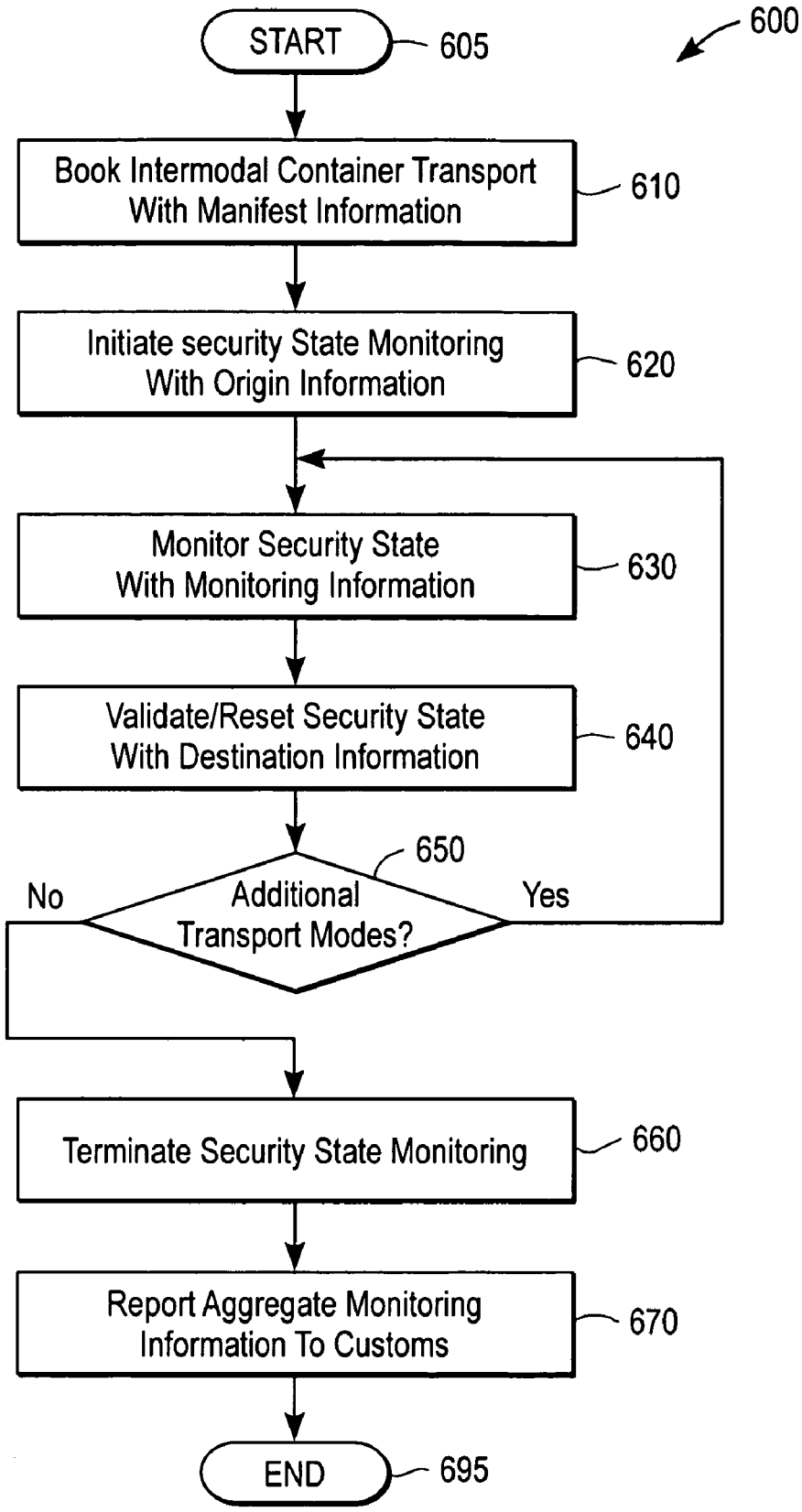
FIG. 6 is a flow chart illustrating a method for tracking the security state according to one embodiment of the present invention.

FIG. 6 is a flow chart illustrating a method 600 for tracking the security state according to one embodiment of the present invention. The system 100 compiles a required body of information containing static and/or dynamic information including manifest information, origin information, monitoring information, destination information, and termination information, an example of which is set forth in Table 1 below.

The shipper 105 books 610 intermodal container transport through the global supply chain with manifest information. Manifest information provided prior to loading containers on a vessel (e.g., at least 24 hours or sufficient time to make decisions concerning specific containers) initializes the security state. Manifest information comprises data elements used by Customs for security profiling, pre-authorization for entry into the import country 102, and other information traditionally used for accessing duties and tariffs. Other manifest information includes container contents, an estimated time of arrival, an anticipated route, a consignee name, Bill of Lading information, and other data elements. This allows the custom control center 120 to preauthorize, reject, or require more stringent standards on a per-container basis. In one embodiment, manifest information is provided in a vessel manifest document, such as CAMIR (Customs Manifest Interface Request) or ANSI EDI X.12 309 (American National Standards Institute—Electronic Data Interchange) forms, provided by U.S. Customs, or a Bill of Lading prepared by shippers 105.

Figure 7:
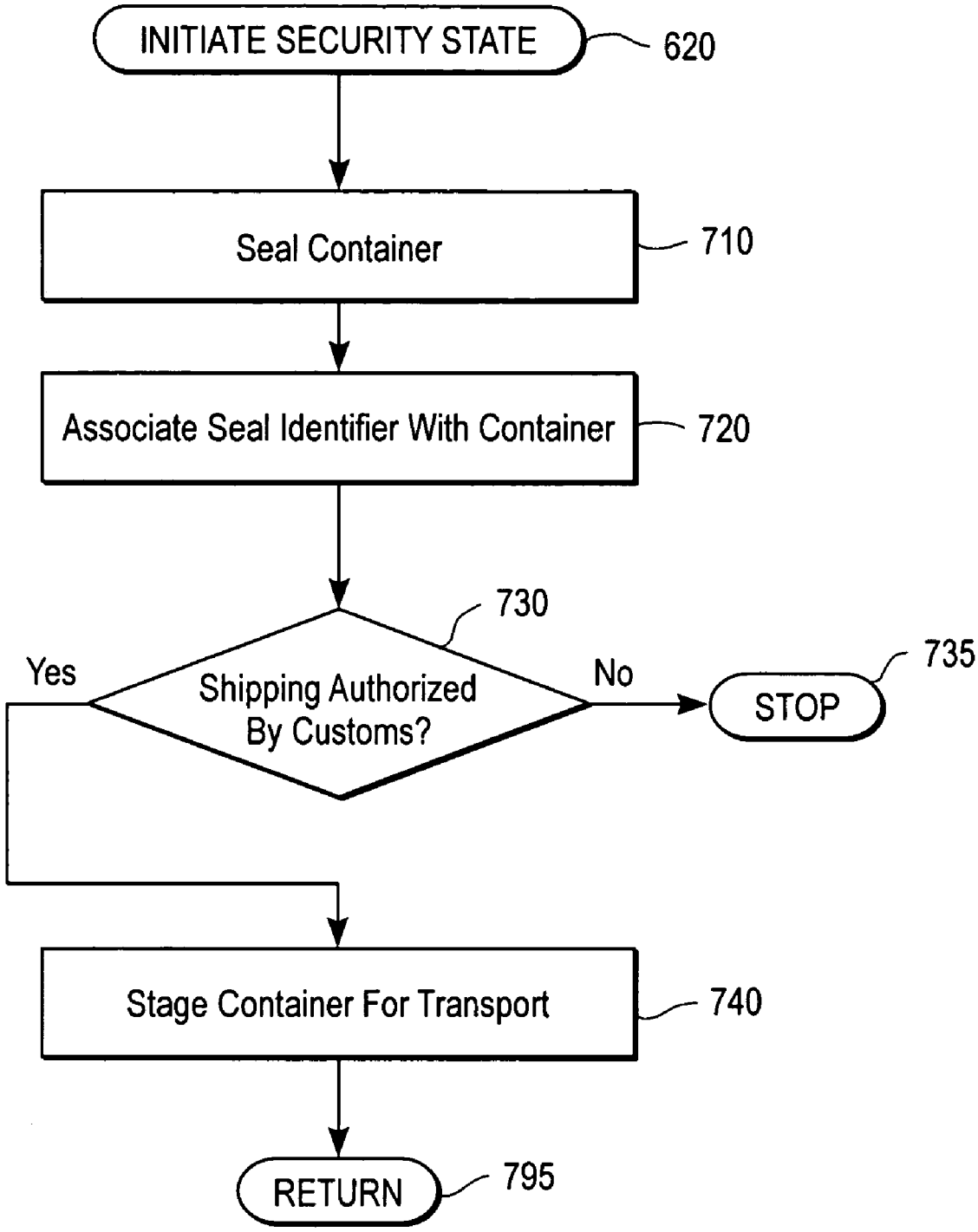
FIG. 7 is a flow chart illustrating a method for initiating the security state according to one embodiment of the present invention.

Before embarking, the shipper 105 initiates 620 security state monitoring with origin information provided by a monitoring agent as described in FIG. 7. The origin information includes updated and/or more specific information relative to the manifest information for the required body of information. For example, a carrier company can be updated or specified so that when the container is loaded with a carrier that deviates from the manifest information, the control center 110 does not raise an alert. The origin information can also include confirmation that a seal was applied to the container, the seal was locked, seal identification information, etc. Note that, although in the described embodiment, the shipper 105 provides manifest information and the origin port 115*a* provides origin information, variations of where individual data elements are presented to the export control center 110*a* are within the scope of the present invention.

Figure 8:
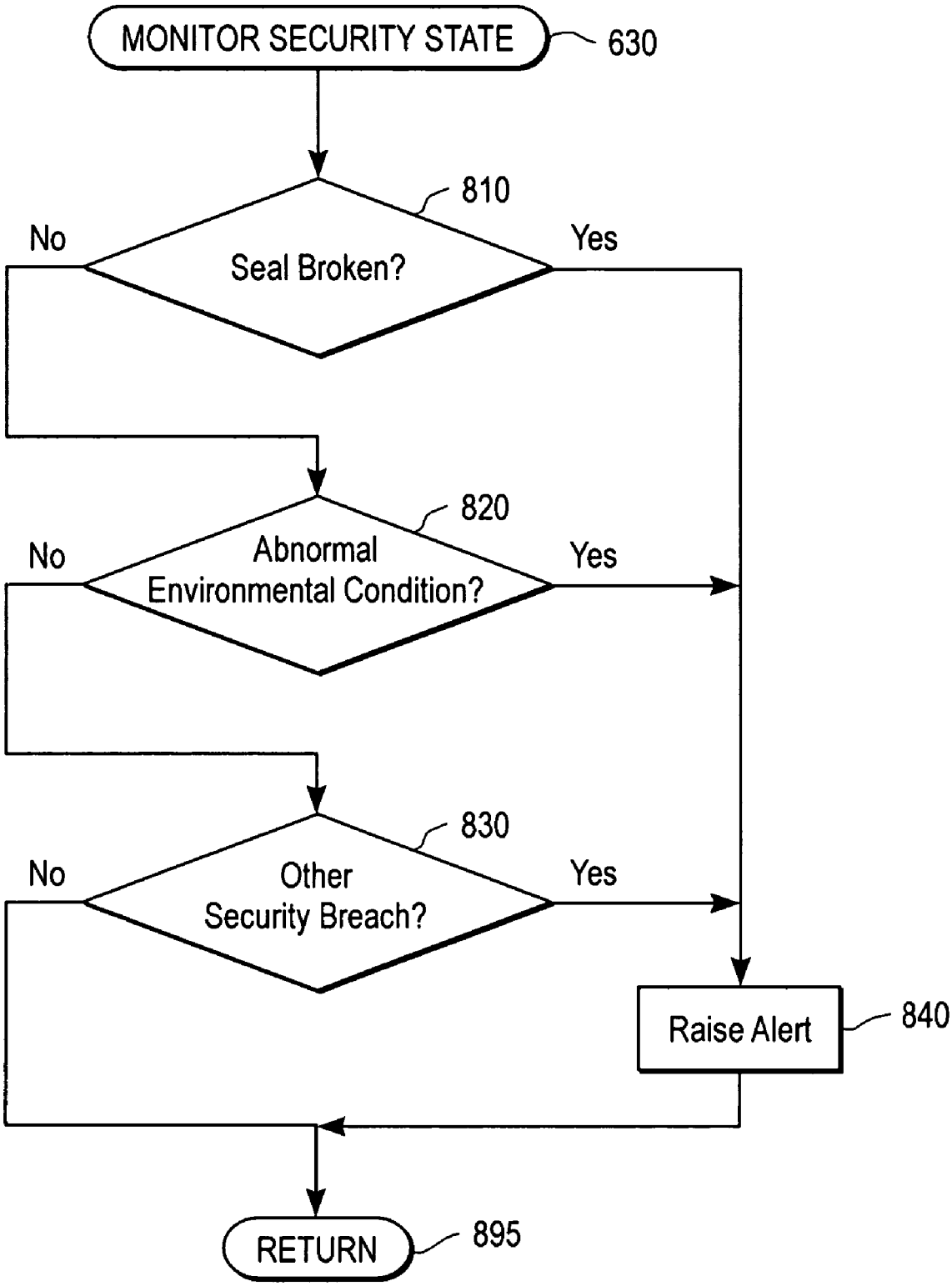
FIG. 8 is a flow chart illustrating a method for monitoring the security state according to one embodiment of the present invention.

The monitoring agent monitors 630 the security state with monitoring information provided by monitoring agents as described in FIG. 8. Monitoring information includes primarily changes in security state such as indicated by a seal device. Additionally, the monitor agent can update the required body of information. For example, an updated estimated time of arrival or shipping route is provided when deviations from the anticipated data element occur. Business logic uses the required body of information, or other monitoring information as state machine inputs where nodes represent security states The destination port 115*c* validates or resets 640 the security state with destination information provided by a destination agent as described in FIG. 9. The destination information provides updates and/or more specific information to the required body of information. If there are additional transport modes 650, the system 100 continues monitoring 630.

If there are no additional transport modes 650, the consignee 125 terminates 660 security state monitoring with termination information. Termination information provides final statistics for dynamic data elements, confirmation that the container was unsealed and unlocked, container condition information, etc. This information is provided by the consignee 125 to conclude monitoring.

Table 1 lists example data can be present within the required body of information:

TABLE 1

| Example of Required Body of Information Data Element |
|---|
| Manifest Information: |
| Bill of Lading Number |
| BOL Date |
| Booking Number |
| Booking Date |
| Reference Numbers (Shipment, Manifest, etc.) |
| Shipping Line/Container Operator |
| Shipper Name |
| Shipper Address |
| Consignee Name |
| Consignee Address |
| ETA Final Destination (Consignee) |
| ETD Shipment Origin |
| Port of Loading |
| ETD Port of Loading |
| Port of Discharge |
| ETA Port of Discharge |
| Port of Destination |
| ETA Port of Destination |
| Vessel Code |
| Vessel Name |
| Voyage Number |
| Commodity Description/Classification |
| Harmonized Tariff Code (6 digits) |
| Pieces and UOM (lowest external packaging level) |
| Weight and UOM |
| Marks & Numbers |
| Container ID |
| Container Size |
| Container Type |
| Seal Number |
| Container Security Monitoring Registration: |
| Container ID |
| Seal Number |
| Seal Key (for electronic seals) |
| Container Gate In Information: |
| Container ID |
| Booking Number |
| Gate In/Out Time |
| Shipping Line/Container Operator |
| Transportation Means Nationality Code |
| Container Size |
| Container Type |
| Gross Weight |
| Seal Number |
| Temperature (for reefer containers) |
| Container Loading/Discharge Information: |
| Container ID |
| Loading/Discharge Date & Time |
| Actual Vessel Code |
| Actual Vessel Name |
| Actual Voyage Number |
| Security Checkpoint (Gates, Yard, Quay, etc.) |
| Status: |
| Seal Number |
| Seal Status |
| Seal Key (for electronic seals) |
| Seal Event Log (for electronic seals) |
| Container Security Status |
| Inspection Results: |
| Inspection Date and Time |
| Inspector Name and ID |
| Inspection Results |
| Inspection Reason Code/Description |
| Scanning Images (if any) |
| Container Security Status |

The data reporting module 330 periodically reports 670 aggregate monitoring information to the customs control center 120.

FIG. 7 is a flow chart illustrating a method 620 for initiating the security state according to one embodiment of the present invention. A trusted agent seals 710 the container with a seal device. The site manager 410 associates a unique seal identifier with the container and writes the identifier to a seal device memory.

If shipping is not authorized 730 by the customs control center 120, the container is not transported 735. In a preferred embodiment, the customs control center 120 uses manifest information for authorization. If shipping is authorized 730 by the customs control center 120, the trusted agent stages 740 the container for transport.

FIG. 8 is a flow chart illustrating a method 630 for monitoring the security state according to one embodiment of the present invention. Preferably, in an extended network, the data centers 110 continuously monitor the security state from the shipper 105 to the consignee 125. In a primary network, the data centers 110 continuously monitor the security state from the origin port 115*a*, through the transshipment port 115*b*, to the destination port 115*c*.

The seal device 510 detects whether the container has been opened 810 or even if there has been an attempt to open. Additionally, the seal device 510 detects whether abnormal environmental conditions exist 820. The seal device 510 also detects additional security breaches 830 as will be recognized by one of ordinary skill in the art. If any of these conditions are detected, the control center 110 raises 840 an alert triggering inspection at the next point.

Figure 9:
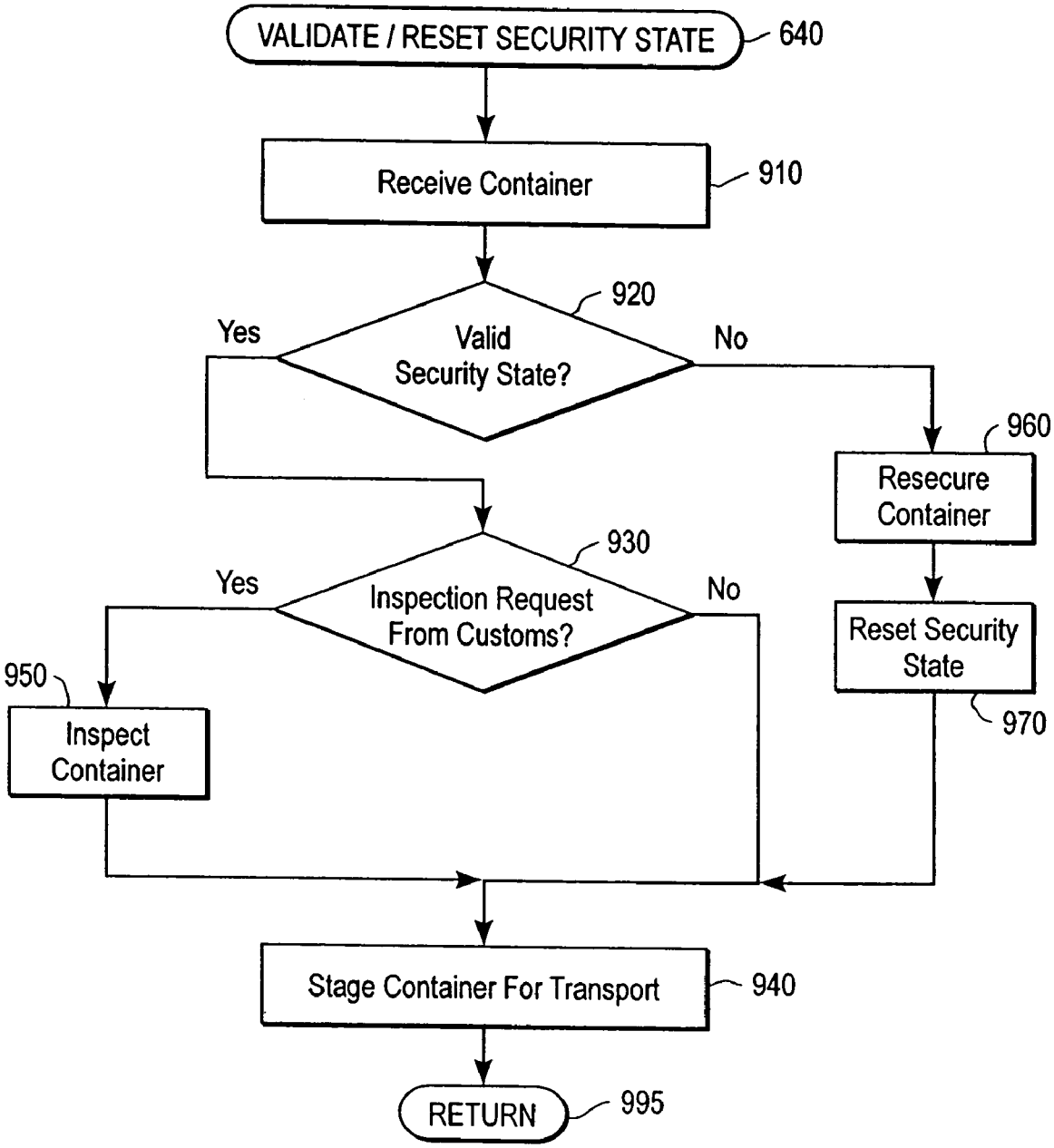
FIG. 9 is a flow chart illustrating a method for validating/resetting the security state according to one embodiment of the present invention.

FIG. 9 is a flow chart illustrating a method 640 for validating/resetting the security state according to one embodiment of the present invention. The port 115 receives 910 the container from a preceding transport mode. A trusted agent determines whether the reported security state is valid 920. If not, the trusted agent resecures 960 the container through an inspection, application of a new seal, or other cure, and resets 970 the security state.

Also, the customs control center 120 can request additional inspections 930 independent of the security state. In this case, the trusted agent inspects 950 the container. Afterwards, the trusted agent stores the container if necessary, and then stages 940 the container for transport.

We claim:

1. A method of tracking a security state for an intermodal container through a global supply chain, comprising:

receiving a credential from a first trusted agent confirming the first trusted agent has trusted status;

receiving a required body of information concerning an intermodal container from the first trusted agent located at a first checkpoint;

initiating a security state for the intermodal container with the required body of information;

monitoring the security state of the container during transport between the first checkpoint and a second checkpoint, the security state adapted to change responsive a security breach;

receiving a credential from a second trusted agent confirming the second trusted agent has trusted status; and sending the security state to the second trusted agent located at the second checkpoint for validation.

2. The method of claim 1, wherein the step of initiating the security state comprises initiating the security state to a secure state responsive to an inspection by the first trusted agent.

3. The method of claim 1, wherein the step of monitoring the security state comprises changing the security state responsive to a security breach defined by security business rules.

4. The method of claim 1, wherein the required body of information comprises an expected transport route between the first checkpoint and the second checkpoint, and wherein the step of monitoring the security state comprises changing the security state if the actual transport route deviates from the expected transport route.

5. The method of claim 1, wherein the required body of information comprises information related to authorized unsealing of the container, and wherein the step of monitoring the security state comprises changing the security state if the container is unsealed without authorization between the first checkpoint and the second checkpoint.

6. The method of claim 1, wherein the required body of information comprises information concerning a unique identifier assigned to a seal that locks the container, and wherein the step of monitoring the security state comprises using the unique identifier to continually monitor the seal for a status.

7. The method of claim 6, wherein the status comprises one from the group consisting of: door open, attempt to open door, door closed, door locked, right door open, and more than one door open.

8. The method of claim 6, wherein the status comprises an environmental state from the group consisting of: temperature, humidity, vibration, shock, light, and radiation.

9. The method of claim 1, further comprising the steps of:

detecting the security breach; and resetting the security state responsive to the second agent submitting an indication that the container was resecured.

10. The method of claim 1, further comprising the steps of:

receiving an inspection request from an authority; and changing the security state responsive to the inspection request.

11. The method of claim 10, further comprising the step of:

submitting the required body of information to the authority;

wherein the authority sends the inspection request responsive to the required body of information.

12. The method of claim 1, wherein the first agent is located at an origin port of an export country and the second agent is located at a destination port of an import country.

13. The method of claim 1, wherein the step of monitoring comprises the steps of:

receiving monitor information from a first reader at the first checkpoint through a first control center;

receiving monitor information from a second reader on a transportation device; and receiving monitor information from a third reader at the second checkpoint through a second control center.

14. The method of claim 13, wherein the container comprises an RFID (Radio Frequency IDentification) tag, and the first, second, and third readers each comprise an RFID reader.

15. A security state system for tracking a container through a global supply chain, comprising:

a first receiving module for receiving a credential from a first trusted agent confirming the first trusted agent has trusted status;

a second receiving module for receiving a required body of information concerning a container submitted by the first trusted agent located at a first checkpoint, the second receiving module coupled to the first receiving module;

a required body of information module to store the required body of information-submitted by the first trusted agent, the required body of information module coupled to the second receiving module;

a third receiving module for receiving a credential from a second trusted agent confirming the second trusted agent has trusted status; and a security state module, coupled to the required body of information module and the third receiving module, the security state module initiating the security state based on the required body of information, the security state module monitoring the security state between the first checkpoint and a second checkpoint, the security state adapted to change responsive to a security breach, and the security state module sending the security state to a second trusted agent at the second checkpoint for validation.

16. The system of claim 15, wherein the security state module initiates the security state to a secure state responsive to an inspection by the first trusted agent.

17. The system of claim 15, wherein the security state module changes the security state responsive to a security breach defined by security business rules.

18. The system of claim 15, wherein the required body of information comprises an expected transport route between the first checkpoint and the second checkpoint, and wherein the security state module changes the security state if the actual transport route deviates from the expected transport route.

19. The system of claim 15, wherein the required body of information comprises authorized unsealing of the container, and wherein the security state module changes the security state if the container is unsealed without authorization between the first checkpoint and the second checkpoint.

20. The system of claim 15, wherein the required body of information comprises a unique identifier assigned to a seal that locks the container, and wherein the security state module uses the unique identifier to continually monitor the seal for a status.

21. The system of claim 20, wherein the status comprises one from the group consisting of: door open, attempt to open door, door closed, door locked, right door open, and more than one door open.

22. The system of claim 20, wherein the status comprises an environmental state from the group consisting of: temperature, humidity, vibration, shock, light, and radiation.

23. The system of claim 15, further comprising a seal device to detect a security breach, wherein the security state module resets the security state responsive to the second agent submitting an indication that the container was resecured.

24. The system of claim 15, wherein the security state module changes the security state responsive to receiving an inspection request from a customs control center.

25. The system of claim 15, wherein the security state module submits the required body of information to a customs control center and receives an inspection request responsive to the required body of information.

26. The system of claim 15, wherein the first agent is located at an origin port of an export country and the second agent is located at a destination port of an import country.

27. The system of claim 15, wherein the required body of information module receives the required body of information from a first reader at the first checkpoint through a first control center, the security state module receives monitoring information from a second reader; and receives a validation confirmation from a third reader at the second checkpoint through a second control center.

28. The system of claim 27, wherein the container comprises an RFID (radio frequency identification) tag, and the first, second, and third readers comprise an RFID reader.

29. A computer product having a computer-readable medium having computer program instructions embodied thereon capable of causing a computer to perform a method of tracking a security state for an intermodal container through a global supply chain, the method comprising:

receiving a credential from a first trusted agent confirming the first trusted agent has trusted status;

receiving a required body of information concerning an intermodal container from the first trusted agent located at a first checkpoint;

initiating a security state for the intermodal container with the required body of information;

monitoring the security state of the container during transport between the first checkpoint and a second checkpoint, the security state adapted to change responsive a security breach;

receiving a credential from a second trusted agent confirming the second trusted agent has trusted status; and sending the security state to the second trusted agent located at the second checkpoint for validation.

30. The computer product of claim 29, wherein the step of initiating the security state comprises initiating the security state to a secure state responsive to an inspection by the first trusted agent.

31. The computer product of claim 29, wherein the step of monitoring the security state comprises changing the security state responsive to a security breach defined by security business rules.

32. The computer product of claim 29, wherein the required body of information comprises information concerning a unique identifier assigned to a seal that locks the container, and wherein the step of monitoring the security state comprises using the unique identifier to continually monitor the seal for a status.

33. The computer product of claim 29, further comprising the steps of:

detecting the security breach; and resetting the security state responsive to the second agent submitting an indication that the container was resecured.

34. The computer product of claim 29, further comprising the steps of:

receiving an inspection request from an authority; and changing the security state responsive to the inspection request.

35. The computer product of claim 34, further comprising the step of:

submitting the required body of information to the authority;

wherein the authority sends the inspection request responsive to the required body of information.

36. The computer product of claim 29, wherein the first agent is located at an origin port of an export country and the second agent is located at a destination port of an import country.

* * * * *

UNITED STATES PATENT AND TRADEMARK OFFICE

CERTIFICATE OF CORRECTION

PATENT NO. : 7,129,837 B2
APPLICATION NO. : 10/821296
DATED : October 31, 2006
INVENTOR(S) : David L. Shannon, Gregory Y. H. Lee and Christopher A. Stephenson It is certified that error appears in the above-identified patent and that said Letters Patent is hereby corrected as shown below:

Column 14,
Line 5, please delete "information-submitted" and insert --information submitted--

Signed and Sealed this

Ninth Day of January, 2007

JON W. DUDAS
*Director of the United States Patent and Trademark Office*